US010568425B2

(12) United States Patent
Chen et al.

(10) Patent No.: US 10,568,425 B2
(45) Date of Patent: Feb. 25, 2020

(54) FURNITURE SYSTEM AND SLIDE RAIL ASSEMBLY THEREOF

(71) Applicants: King Slide Works Co., Ltd., Kaohsiung (TW); King Slide Technology Co., Ltd., Kaohsiung (TW)

(72) Inventors: Ken-Ching Chen, Kaohsiung (TW); Fang-Cheng Su, Kaohsiung (TW); Ci-Bin Huang, Kaohsiung (TW); Yue-Hua Tang, Kaohsiung (TW); Chun-Chiang Wang, Kaohsiung (TW)

(73) Assignees: King Slide Works Co., Ltd., Kaohsiung (TW); King Slide Technology Co., Ltd., Kaohsiung (TW)

( * ) Notice: Subject to any disclaimer, the term of this patent is extended or adjusted under 35 U.S.C. 154(b) by 0 days.

(21) Appl. No.: 16/003,172

(22) Filed: Jun. 8, 2018

(65) Prior Publication Data

US 2019/0216219 A1 Jul. 18, 2019

(30) Foreign Application Priority Data

Jan. 18, 2018 (TW) ..... 107102142 A

(51) Int. Cl.

| | |
|---|---|
| ***A47B 88/423*** | (2017.01) |
| ***A47B 88/49*** | (2017.01) |
| ***A47B 88/477*** | (2017.01) |
| ***A47B 88/407*** | (2017.01) |
| ***A47B 88/427*** | (2017.01) |

(52) U.S. Cl.

CPC ..... *A47B 88/423* (2017.01); *A47B 88/407* (2017.01); *A47B 88/427* (2017.01); (Continued)

(58) Field of Classification Search

CPC ..... A47B 88/427; A47B 88/407; A47B 2088/4272; A47B 2088/4276; (Continued)

(56) References Cited

U.S. PATENT DOCUMENTS 4,778,230 A * 10/1988 Lautenschlager .... A47B 88/427 312/334.5

8,854,769 B1 10/2014 Liang et al.

(Continued)

FOREIGN PATENT DOCUMENTS

CN 105188479 B 11/2017

DE 20321444 U1 6/2007

(Continued)

*Primary Examiner* — Hiwot E Tefera

(74) *Attorney, Agent, or Firm* — Alan D. Kamrath; Karin L. Williams; Mayer & Williams PC

(57) ABSTRACT

A slide rail assembly is applicable to a furniture system. The slide rail assembly includes a first rail, a second rail, a blocking structure and an adjusting device. The second rail is longitudinally movable relative to the first rail. The blocking structure is arranged on one of the first rail and the second rail. The adjusting device is arranged on the other one of the first rail and the second rail. The adjusting device includes a working member and an adjusting member. The adjusting member is configured to adjust the working member to be located at different positions. Wherein, the working member is configured to abut against the blocking structure at different positions to allow the second rail to be located at different longitudinal positions when the second rail is retracted relative to the first rail.

11 Claims, 10 Drawing Sheets

(52) U.S. Cl.
CPC ..... *A47B 88/477* (2017.01); *A47B 88/49* (2017.01); *A47B 2088/4272* (2017.01)

(58) Field of Classification Search
CPC .... A47B 2088/4278; A47B 2088/4274; A47B 2210/0056; A47B 2230/0014; A47B 88/49; A47B 2210/0054; A47B 88/423; A47B 88/477; A47B 88/483; F16C 29/02
USPC ..... 312/334.5
See application file for complete search history.

(56) References Cited

U.S. PATENT DOCUMENTS

| | | | | |
|---|---|---|---|---|
| 8,979,223 | B2 | 3/2015 | Huang | |
| 9,179,771 | B2 | 11/2015 | Haemmerle et al. | |
| 2004/0239219 | A1* | 12/2004 | Kim | A47B 88/427 312/334.4 |
| 2009/0212679 | A1* | 8/2009 | Frousiakis | A47B 88/427 312/334.1 |
| 2012/0319548 | A1* | 12/2012 | Netzer | A47B 88/427 312/334.1 |
| 2015/0366346 | A1* | 12/2015 | Raid | A47B 88/427 312/334.44 |
| 2017/0105525 | A1* | 4/2017 | Klaus | A47B 88/427 |
| 2017/0172299 | A1* | 6/2017 | Schneider | F16C 29/001 |
| 2018/0146783 | A1* | 5/2018 | Stuffel | A47B 88/427 |

FOREIGN PATENT DOCUMENTS

| | | | |
|---|---|---|---|
| DE | 202010013193 | U1 | 5/2012 |
| JP | 3159129 | U | 5/2010 |

* cited by examiner

FURNITURE SYSTEM AND SLIDE RAIL ASSEMBLY THEREOF

BACKGROUND OF THE INVENTION

1. Field of the Invention

The present invention relates to a slide rail assembly, and more particularly to a slide rail assembly applicable to a furniture system.

2. Description of the Prior Art

Generally, a slide rail assembly is widely used for various applications. For example, the slide rail assembly can be used in a furniture system or a rack system of an electronic device. In the furniture system, the slide rail assembly comprises a fixed rail and a movable rail longitudinally movable relative to the fixed rail. Wherein, the fixed rail is usually mounted and fixed to a cabinet, and the movable rail is configured to carry a drawer, such that the drawer is movable relative to the cabinet through the movable rail.

However, there may be different requirements in the market, such as a requirement of matching lengths of the cabinet and the drawer to meet a mounting tolerance, or a requirement of preventing improper depth positions when the movable rail is retracted relative to the fixed rail. Due to such requirements, a slide rail assembly or a furniture system having an adjusting function has been developed.

U.S. Pat. No. 9,179,771 B2 discloses a coupling device (5) for drawers. Wherein, the coupling device (5) is configured to releasably couple a drawer to a rail of an extension guide. The coupling device (5) has an adjusting wheel for adjusting a position of the drawer relative to a cabinet. The case is provided for reference.

However, the adjusting wheel is arranged on the coupling device (5). For different market requirements, such arrangement may not be useful to achieve the adjusting function. Therefore, it is important to develop a different related product.

SUMMARY OF THE INVENTION

The present invention relates to a slide rail assembly and a furniture system capable of adjusting depth.

According to an embodiment of the present invention, a slide rail assembly comprises a first rail, a second rail, a blocking structure and an adjusting device. The second rail is longitudinally movable relative to the first rail. The blocking structure is arranged on one of the first rail and the second rail. The adjusting device is arranged on the other one of the first rail and the second rail. The adjusting device comprises an adjusting member, a working member and a fixing frame. Wherein, the working member is configured to abut against the blocking structure, and the adjusting member is configured to rotate to drive the working member to move linearly relative to the fixing frame, in order to adjust a position of the second rail along a longitudinal direction of the first rail when the second rail is retracted relative to the first rail.

Preferably, the blocking structure is fixed to one of the first rail and the second rail.

Preferably, the fixing frame comprises a first wall and a second wall. A space is defined between the first wall and the second wall. The adjusting member is accommodated in the space. The adjusting member has a first side and a second side opposite to the first side. The first side has a shaft part connected to the first wall. A screwing part of the working member is screwed to the adjusting member from the second side. A contact part of the working member is located outside the space. The working member is configured to abut against the blocking structure through the contact part.

Preferably, the working member further comprises a middle part connected between the screwing part and the contact part. The second wall has a hole allowing the middle part to penetrate through.

Preferably, the hole and the middle part have non-circular contours corresponding to each other.

Preferably, the blocking structure comprises a base having a room and a blocking member accommodated in the room. The blocking member is configured to abut against the working member.

Preferably, the slide rail assembly further comprises a third rail movably mounted between the first rail and second rail for extending a traveling distance of the second rail relative to the first rail.

According to another embodiment of the present invention, a slide rail assembly comprises a first rail, a second rail, a blocking structure and an adjusting device. The second rail is longitudinally movable relative to the first rail. The second rail has a front part and a rear part. The blocking structure is arranged on the first rail. The adjusting device is arranged on the second rail. The adjusting device comprises a working member and an adjusting member. The working member and the adjusting member are screwed to each other. Wherein, when the second rail is retracted relative to the first rail and the working member is adjusted by the adjusting member to be located at a first position to abut against the blocking structure, a first distance is defined between the front part of the second rail and the blocking structure. Wherein, when the second rail is retracted relative to the first rail and the working member is adjusted by the adjusting member to be located at a second position to abut against the blocking structure, a second distance is defined between the front part of the second rail and the blocking structure. The second distance is different from the first distance.

Preferably, the adjusting device further comprises a fixing frame fixed to the second rail. The fixing frame comprises a first wall and a second wall. A space is defined between the first wall and the second wall. The adjusting member is accommodated in the space. The adjusting member has a first side and a second side opposite to the first side. The first side has a shaft part connected to the first wall. A screwing part of the working member is screwed to the adjusting member from the second side. A contact part of the working member is located outside the space. The working member is configured to abut against the blocking structure through the contact part.

According to another embodiment of the present invention, a furniture system comprises a first furniture part, a second furniture part, a first rail, a second rail, a blocking structure, and an adjusting member. The first rail is fixed to the first furniture part. The second rail is configured to carry the second furniture part. The second rail is longitudinally movable relative to the first rail. The blocking structure is arranged on one of the first rail and the first furniture part. The adjusting device is arranged on one of the second rail and the second furniture part. The adjusting device comprises a working member and an adjusting member. The working member and the adjusting member are screwed to each other. Wherein, when the second rail is retracted relative to the first rail and the working member is adjusted by the adjusting member to be located at a first position to abut against the blocking structure, a first longitudinal distance is defined between a front panel of the second furniture part and the blocking structure. Wherein, when the second rail is retracted relative to the first rail and the working member is adjusted by the adjusting member to be located at a second position to abut against the blocking structure, a second longitudinal distance is defined between the front panel of the second furniture part and the blocking structure. The second longitudinal distance is different from the first longitudinal distance.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
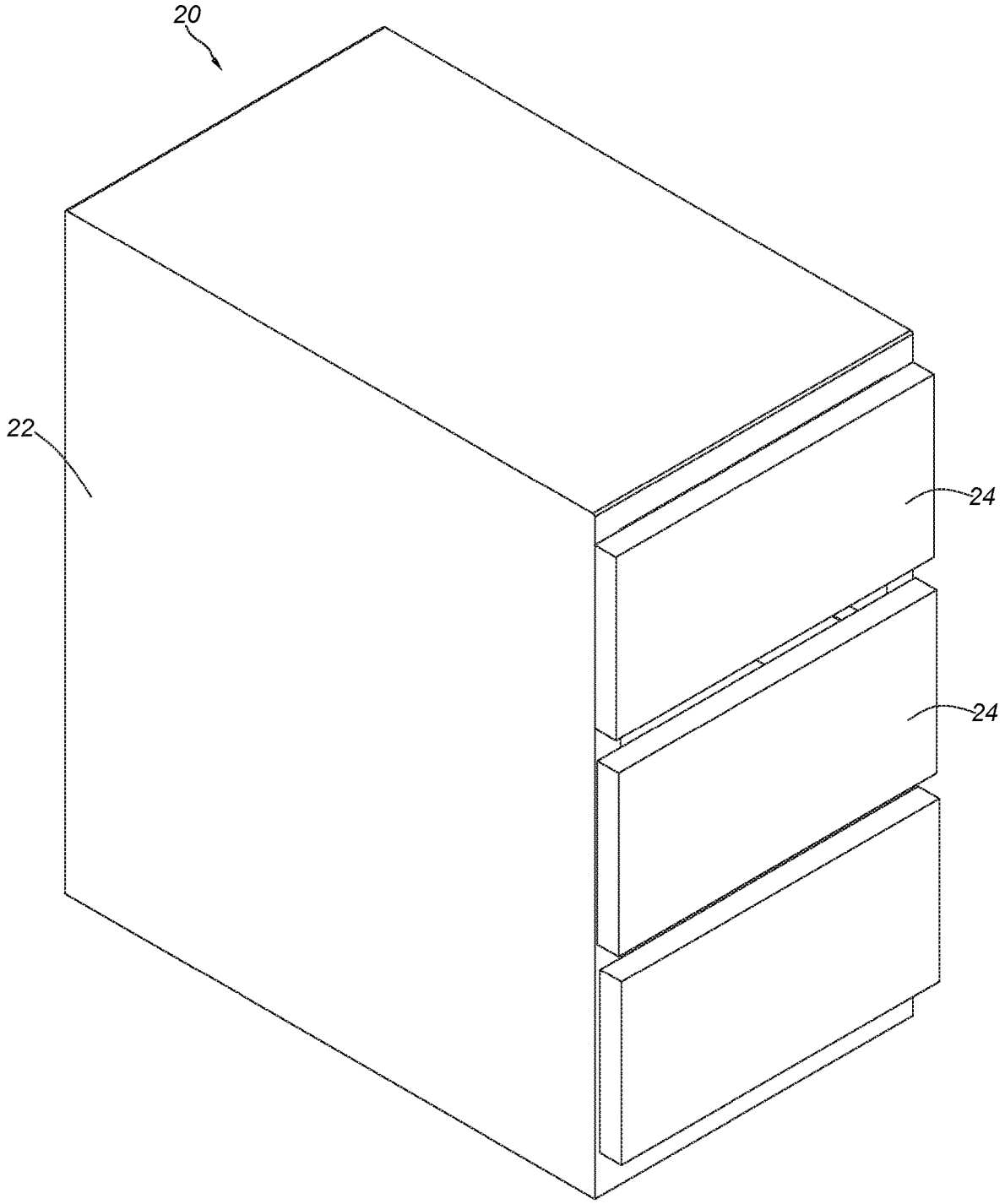
FIG. 1 is a diagram showing a furniture system according to an embodiment of the present invention.

As shown in FIG. 1, a furniture system 20 of the present invention comprises a first furniture part 22 and a second furniture part 24. In the present embodiment, the first furniture part 22 is a cabinet, and the second furniture part 24 is a drawer. FIG. 1 shows that the furniture system 20 comprises three drawers, but the quantity of the drawer is not limited in the present invention.

Figure 2:
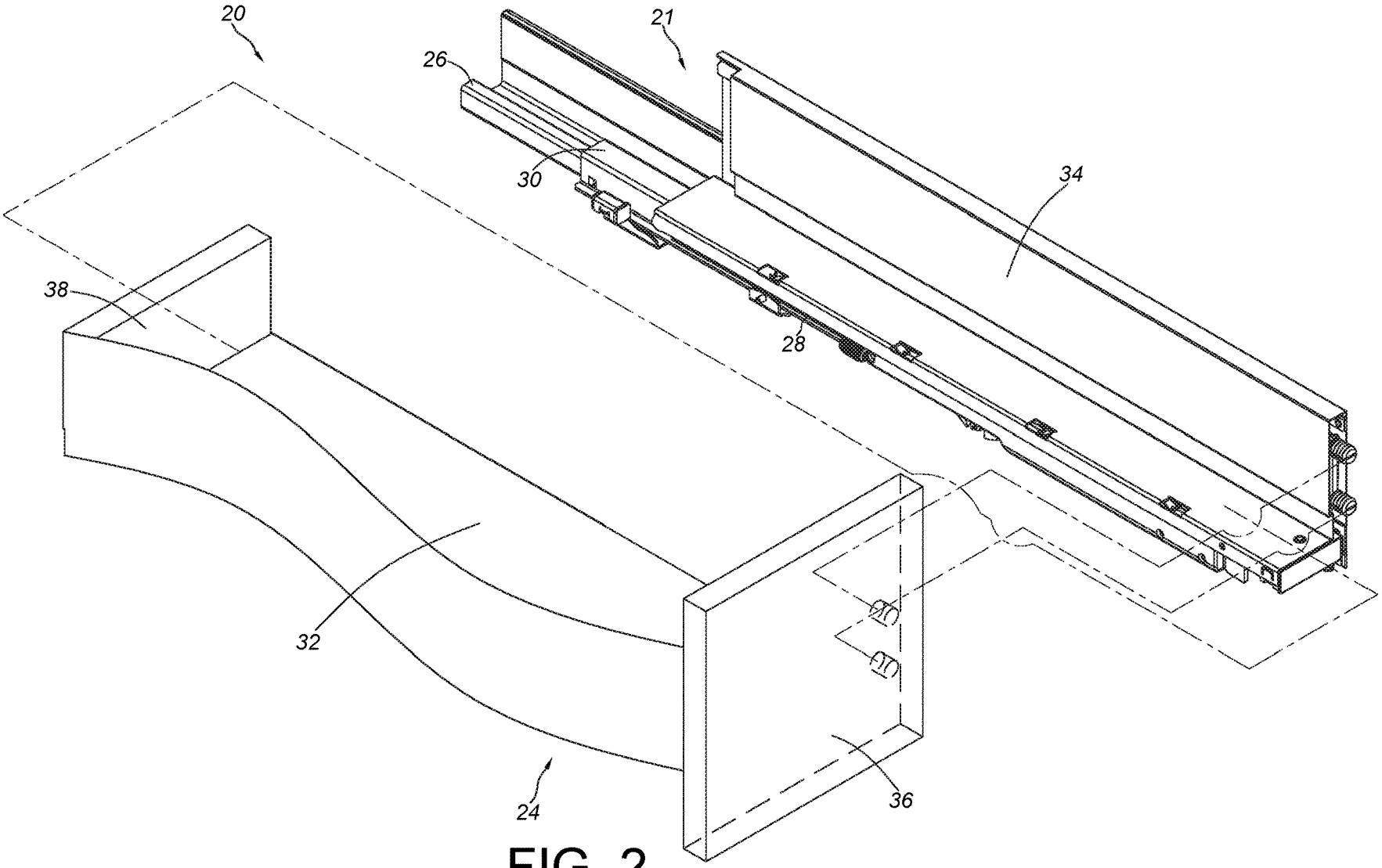
FIG. 2 is an exploded view of a furniture part and a slide rail assembly according to an embodiment of the present invention.

As shown in FIG. 2, the furniture system 20 further comprises a slide rail assembly 21 having a first rail 26 and a second rail 28 longitudinally movable relative to the first rail 26. Preferably, the slide rail assembly 21 further comprises a third rail 30 movably mounted between the first rail 26 and the second rail 28 for extending a longitudinal traveling distance of the second rail 28 relative to the first rail 26. Wherein, the second furniture part 24 comprises a bottom wall 32, a side wall 34, a front panel 36 and a rear wall 38 for defining a drawer space. Wherein, the second rail 28 is configured to carry the second furniture part 24. In the present embodiment, the side wall 34 of the second furniture part 24 can be mounted to the second rail 28 in advance, and the front panel 36 of the second furniture part 24 is detachably fixed to a front end part of the side wall 34. On the other hand, the first rail 26 is fixed to the first furniture part 22. According to such arrangement, the second furniture part 24 is movable relative to the first rail 26 (or the first furniture part 22) through the second rail 28. Such configuration is well known to those skilled in the art, for simplification, no further illustration is provided.

Figure 3:
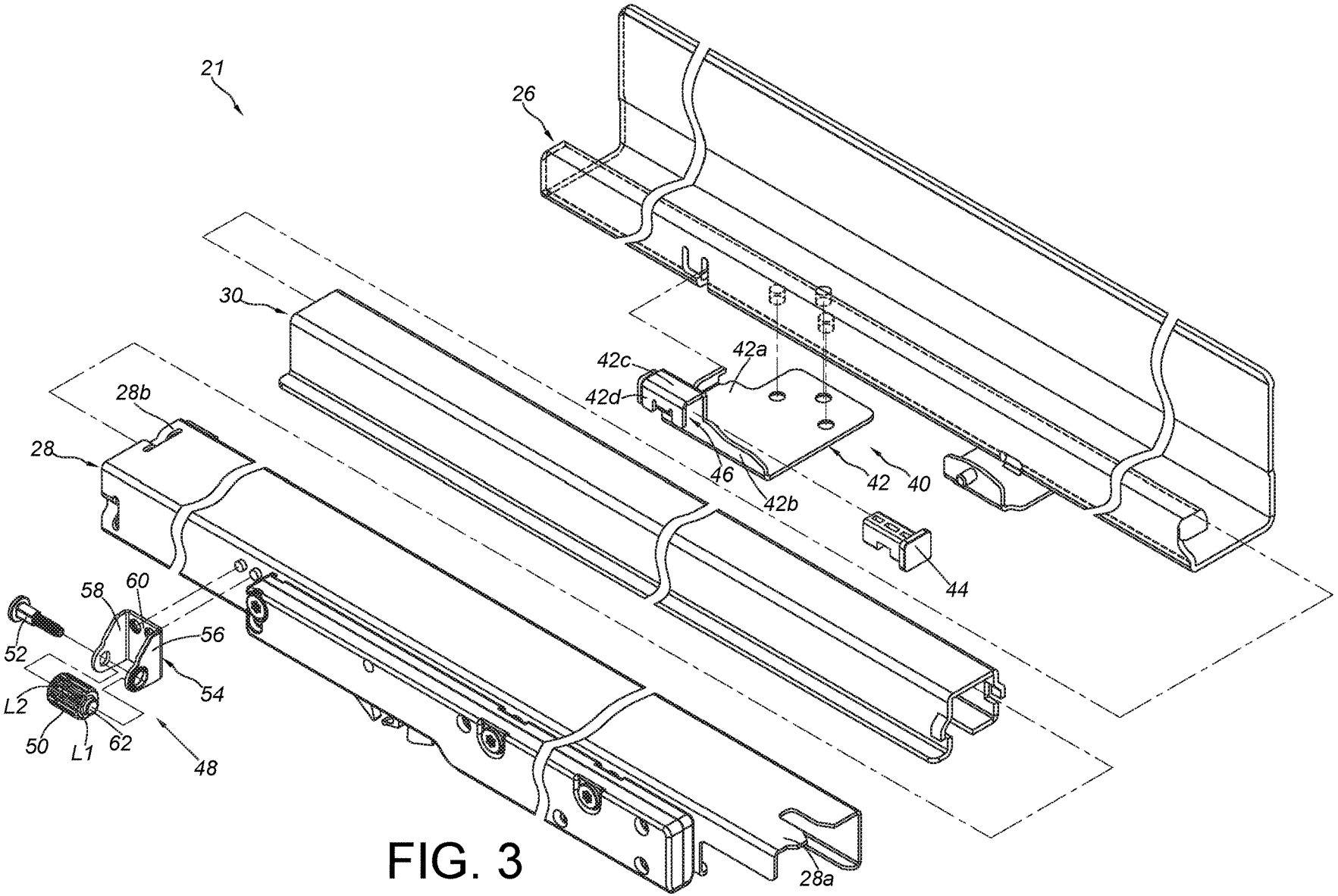
FIG. 3 is an exploded view of the slide rail assembly according to an embodiment of the present invention.
Figures 4, 4A:
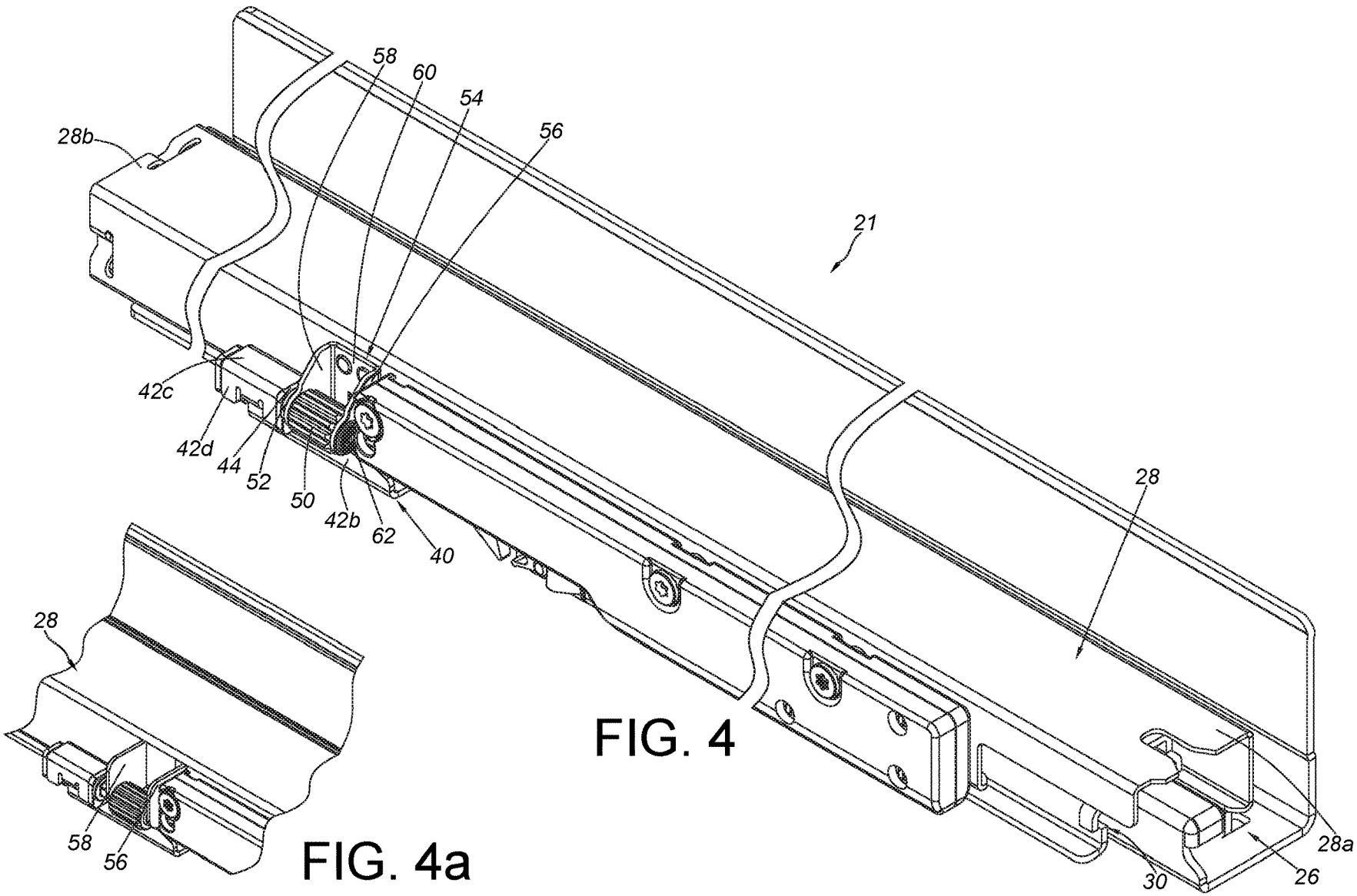
FIG. 4 is a diagram showing the slide rail assembly according to an embodiment of the present invention.
FIG. 4*a* is a diagram showing another fixing frame of an adjusting device according to an embodiment of the present invention.

As shown in FIG. 3 and FIG. 4, the slide rail assembly 21 further comprises a blocking structure 40 arranged on one of the first rail 26 (fixed member) and the second rail 28 (movable member). In the present embodiment, the blocking structure 40 is arranged on the first rail 26, but the present invention is not limited thereto. When the blocking structure 40 is configured to be arranged on the fixed member of the furniture system 20, the blocking structure 40 can be arranged on one of the first rail 26 and the first furniture part 22. Preferably, the blocking structure 40 is fixed to the first rail 26, and the blocking structure 40 comprises a base 42 and a blocking member 44. The base 42 has a connecting part 42*a*, a vertical part 42*b*, a first bending part 42*c* and a second bending part 42*d*. Wherein, the connecting part 42*a* is fixedly connected to a bottom part of the first rail 26 and laterally extended from the bottom part of the first rail 26. The vertical part 42*b* is substantially perpendicularly connected to the connecting part 42*a*. The first bending part 42*c* is connected between the vertical part 42*b* and the second bending part 42*d*. Wherein, a room 46 is defined by the vertical part 42*b*, the first bending part 42*c* and the second bending part 42*d*; and the blocking member 44 is accommodated in the room 46. In the present embodiment, the blocking member 44 is fixed to the base 42 by engaging, and the blocking member 44 is partially exposed outside the room 46.

Furthermore, the slide rail assembly 21 further comprises an adjusting device 48 arranged on the other one of the first rail 26 (fixed member) and the second rail 28 (movable member). In the present embodiment, the adjusting device 48 is arranged on a lateral side of the second rail 28 between a front part 28*a* and a rear part 28*b* of the second rail 28, but the present invention is not limited thereto. When the adjusting device 48 is configured to be arranged on the movable member of the furniture system 40, the adjusting device 48 can be arranged one of the second rail 28 and the second furniture part 24. The adjusting device 48 comprises an adjusting member 50, a working member 52 and a fixing frame 54.

Figure 5:
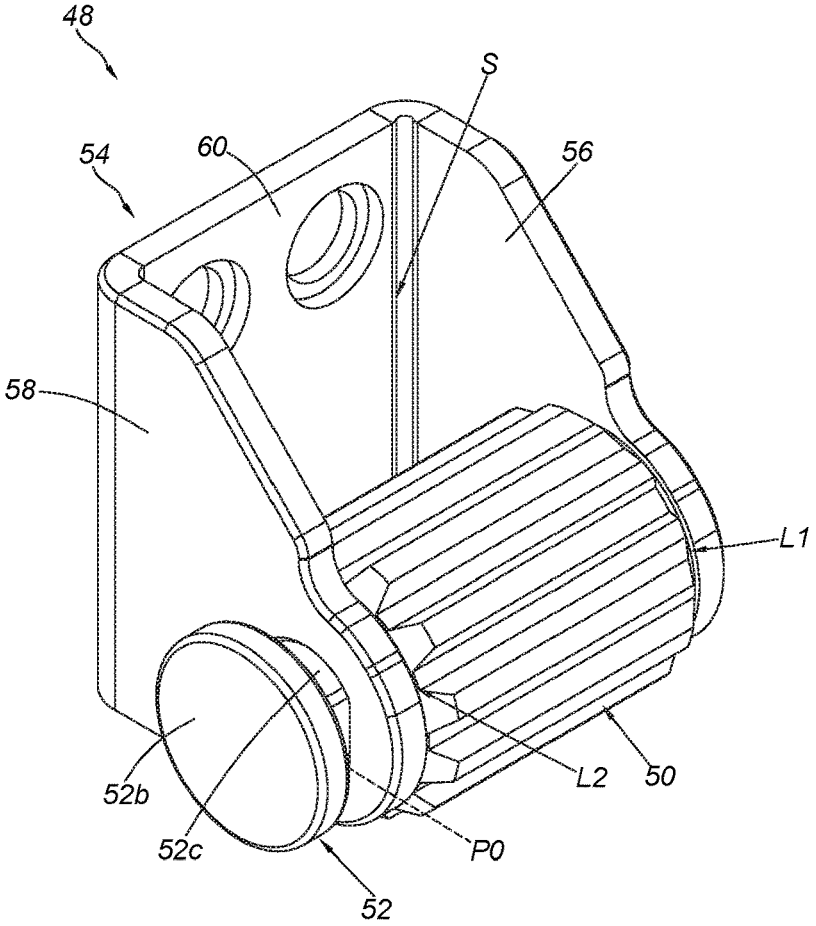
FIG. 5 is a diagram showing the adjusting device according to an embodiment of the present invention.
Figure 6:
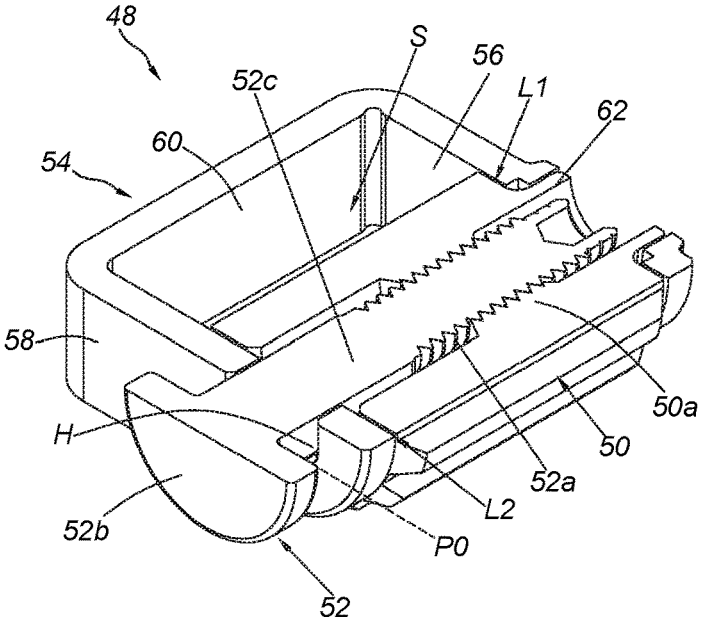
FIG. 6 is a cross-sectional view of the adjusting device according to an embodiment of the present invention.

As shown in FIG. 4, FIG. 5 and FIG. 6, the fixing frame 54 comprises a first wall 56 and a second wall 58. Preferably, a middle wall 60 is arranged between the first wall 56 and the second wall 58. The first wall 56 and the second wall 58 are substantially perpendicularly connected to the middle wall 60. Wherein, the middle wall 60 is fixed to the second rail 28. For example, the middle wall 60 can be fixed to the second rail 28 by screwing, riveting, engaging or welding (please refer to FIG. 4). On the other hand, when the adjusting device 48 is configured to be arranged on the fixed member of the furniture system 20, the middle wall 60 can be fixed to the first rail 26 or the first furniture part 22. As shown in FIG. 4*a*, in other embodiments, the first wall 56 and the second wall 58 of the fixing frame can be integrated with the second rail 28 and arranged on the lateral side of the second rail 28. Therefore, the present invention is not limited thereto. On the other hand, when the adjusting device 48 is configured to be arranged on the fixed member of the furniture system 20, the first wall 56 and the second wall 58 of the fixing frame 54 can be integrated with the first rail 26 or the first furniture part 22.

As shown in FIG. 5 and FIG. 6, a space S is defined between the first wall 56 and the second wall 58 of the fixing frame 54. The adjusting member 50 is accommodated in the space S. The adjusting member 50 has a first side L1 and a second side L2 opposite to the first side L1, and the first side L1 and the second side L2 respectively correspond to the first wall 56 and the second wall 58, such that the adjusting member 50 can be limited between the first wall 56 and the second wall 58. The first side L1 has a shaft part 62 pivoted to the first wall.

The working member 52 comprises a screwing part 52*a*, a contact part 52*b* and a middle part 52*c*. The middle part 52*c* is connected between the screwing part 52*a* and the contact part 52*b*. The middle part 52*c* and the screwing part 52*a* of the working member 52 are configured to pass through a hole H of the second wall 58 and the second side L2 of the adjusting member 50 to be inserted into the adjusting member 50. The screwing part 52*a* is screwed to a Corresponding thread part 50*a* of the adjusting member 50. Wherein, the contact part 52*b* of the working member 52 is located outside the space S of the fixing frame 54. Therefore, the adjusting member 50 and the working member 52 are screwed to each other. Wherein, the working member 52 is located at an initial position P0 before the adjusting member 50 is rotated.

Figure 7:
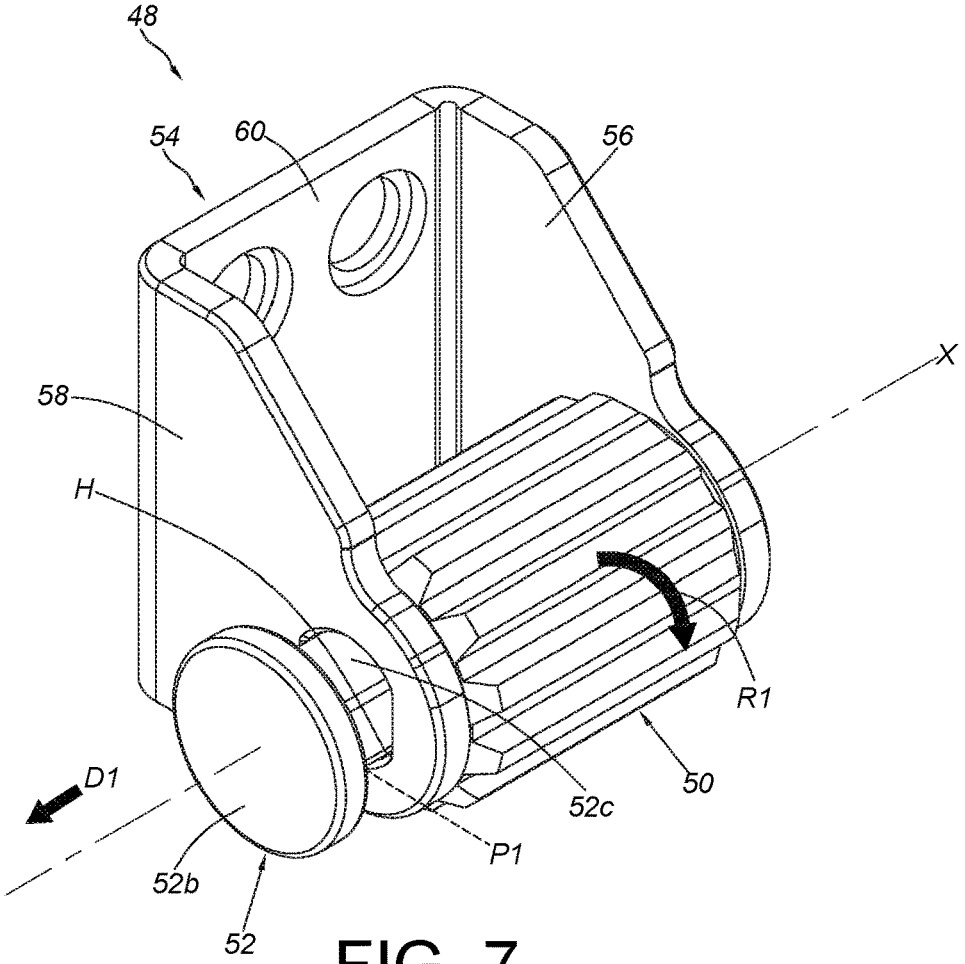
FIG. 7 is a diagram showing an adjusting member of the adjusting device being adjusted to drive a working member to move to a first position according to an embodiment of the present invention.
Figure 8:
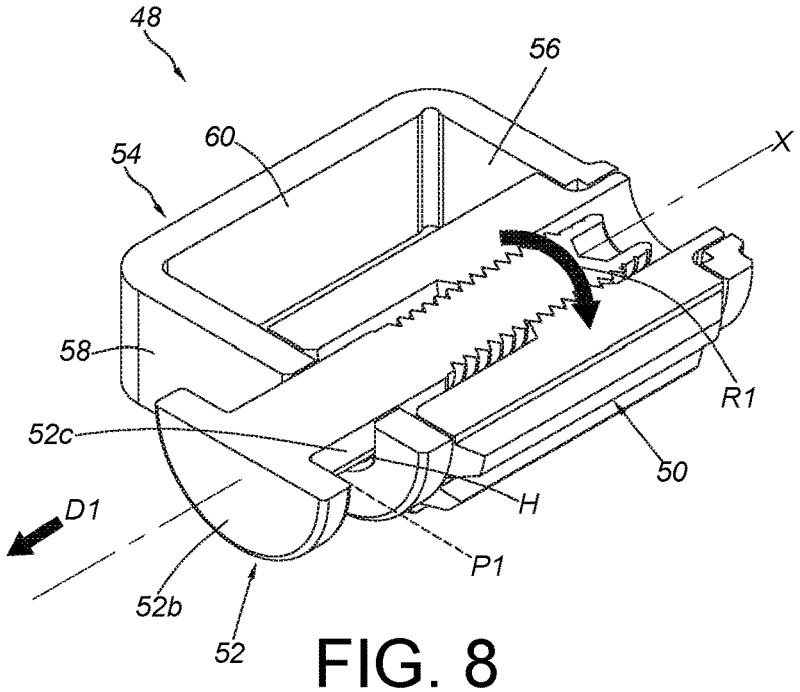
FIG. 8 is a cross-sectional view of the adjusting member of the adjusting device being adjusted to drive the working member to move to the first position according to an embodiment of the present invention.

As shown in FIG. 7 and FIG. 8, the adjusting device 48 is configured to convert a rotational movement of the adjusting member 50 into a linear movement of the working member 52 relative to the fixing frame 54 along a linear direction X. For example, when the adjusting member 50 is rotated along a first rotational direction R1, the working member 52 is linearly moved relative to the fixing frame 54 along a first direction D1 to a first position P1 in response to the rotation of the adjusting member 50. Moreover, the hole H of the second wall 58 allows the middle part 52*c* of the working member 52 to penetrate through. In the present embodiment, a contour of the middle part 52*c* is substantially identical to a shape of the hole H. Preferably, the hole H is a non-circular hole. In other words, the hole H and the middle part 52*c* have non-circular contours corresponding to each other.

Figure 9:
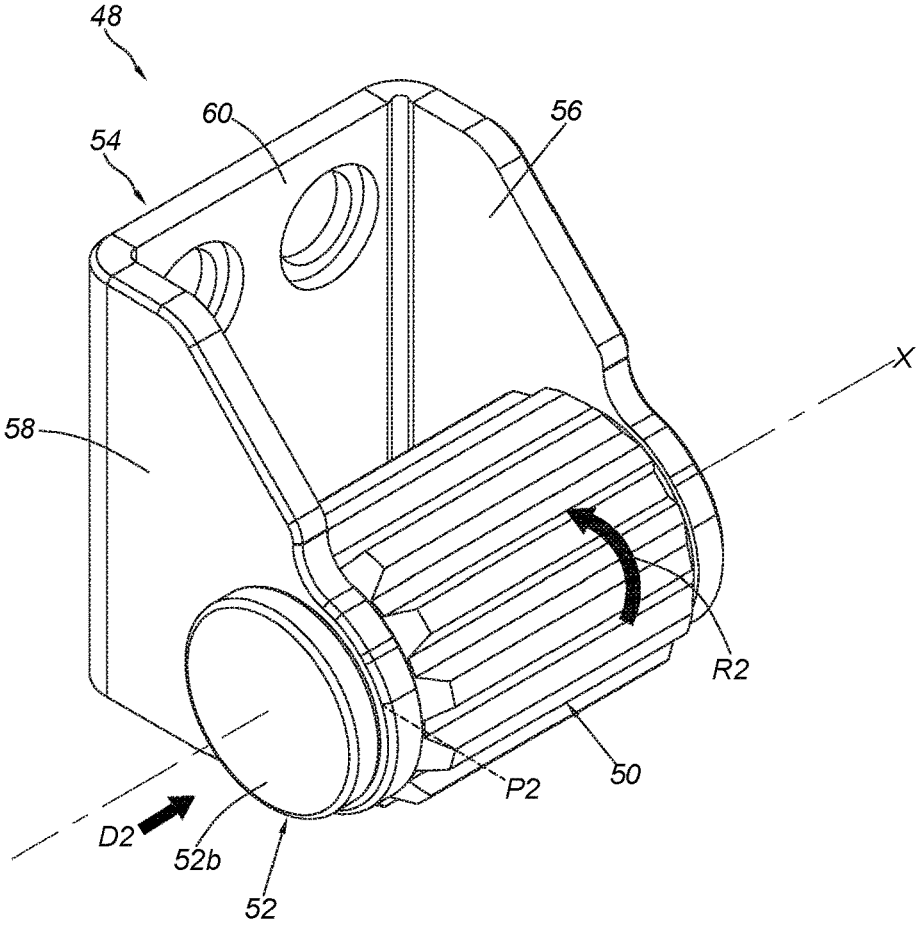
FIG. 9 is a diagram showing the adjusting member of the adjusting device being adjusted to drive the working member to move to a second position according to an embodiment of the present invention.
Figure 10:
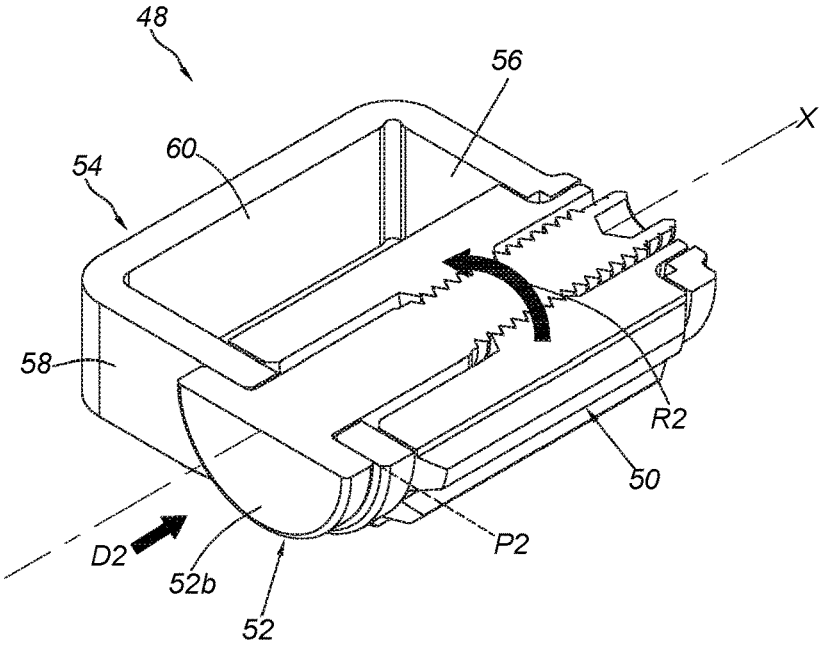
FIG. 10 is a cross-sectional view of the adjusting member of the adjusting device being adjusted to drive the working member to move to the second position according to an embodiment of the present invention.

On the other hand, as shown in FIG. 9 and FIG. 10, when the adjusting member 50 is rotated along a second rotational direction R2, the working member 52 is linearly moved relative to the fixing frame 54 along a second direction D2 to a second position P2 in response to the rotation of the adjusting member 50. Wherein, the second rotational direction R2 is opposite to the first rotational direction R1, and the second direction D2 is opposite to the first direction D1.

Figure 11:
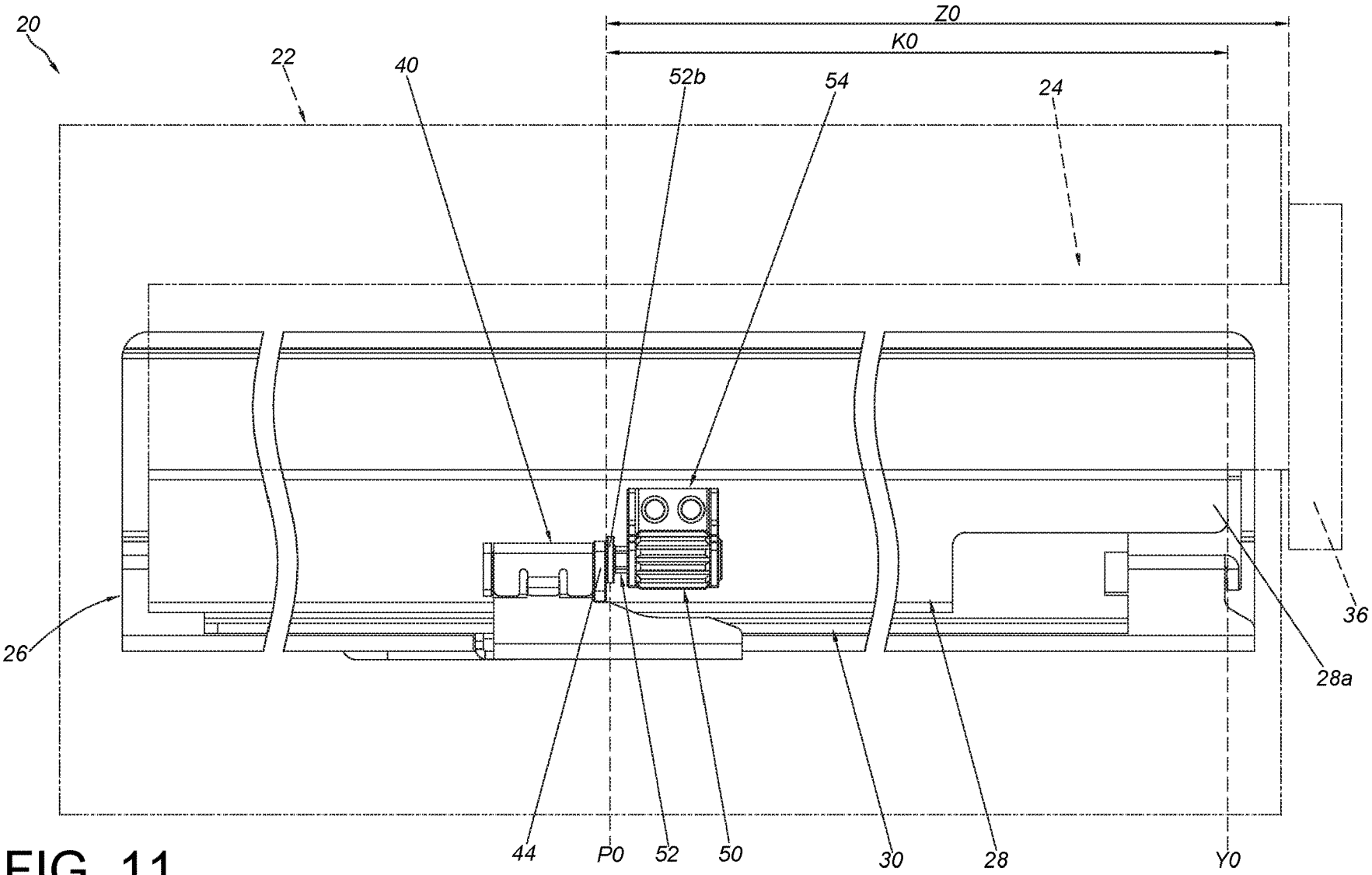
FIG. 11 is a diagram showing a second rail of the slide rail assembly of the furniture system being retracted to be located at an initial longitudinal position according to an embodiment of the present invention.

As shown in FIG. 11, the adjusting member 50 has not been rotated and the working member 52 is located at the initial position P0. In such state, when the second rail 28 (or the second furniture part 24) is retracted (such as completely retracted) relative to the first rail 26 (or the first furniture part 22), the working member 52 at the initial position P0 is configured to abut against the blocking structure 40. For example, the contact part 52*b* of the working member 52 abuts against the blocking member 44 of the blocking structure 40, such that the second rail 28 is located at an initial longitudinal position Y0 relative to the first rail 26. Meanwhile, an initial distance K0 is defined between the front part 28*a* of the second rail 28 and the blocking structure 40. On the other hand, an initial longitudinal distance Z0 is defined between the front panel 36 of the second furniture part 24 and the blocking structure 40.

Figure 12:
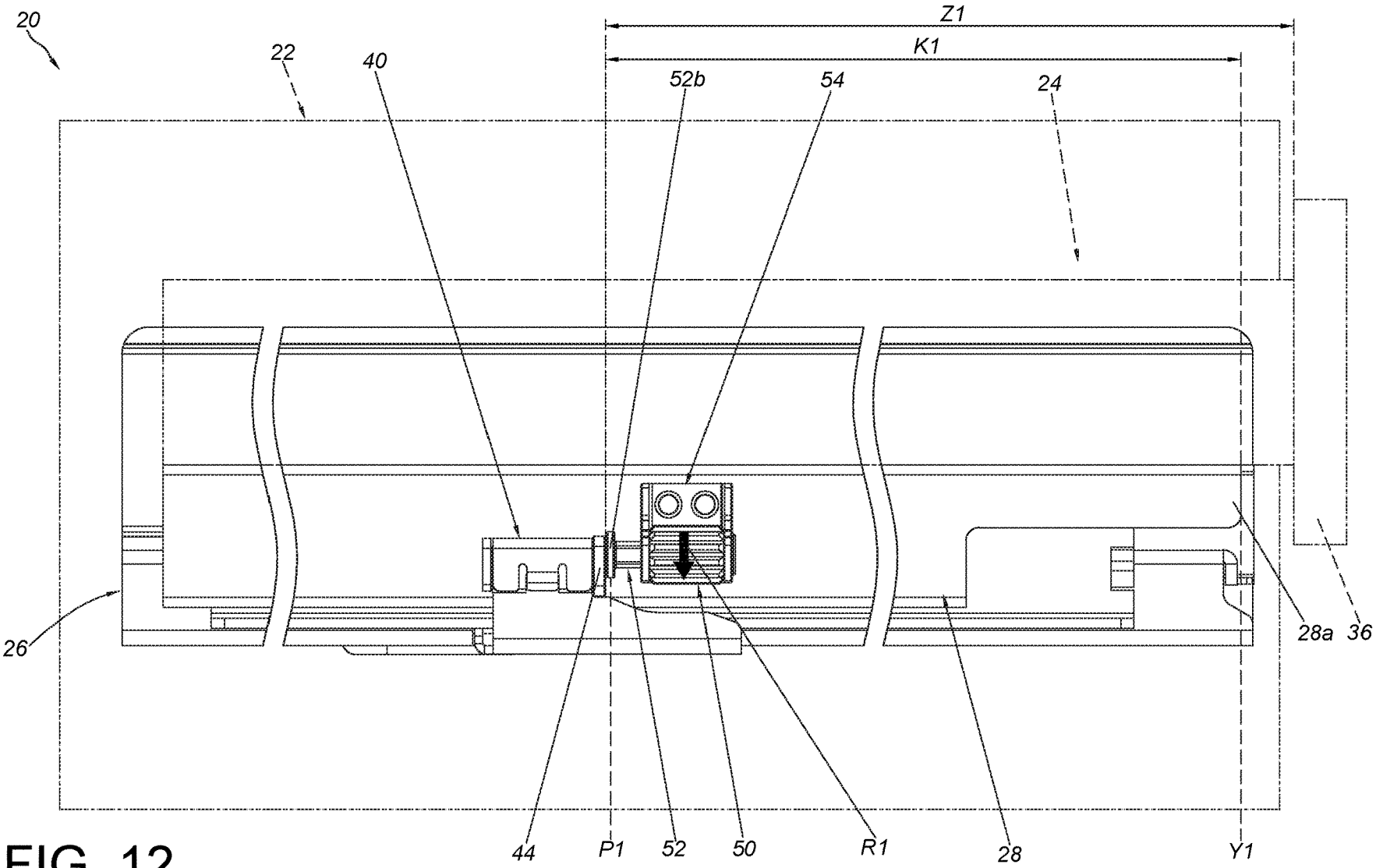
FIG. 12 is a diagram showing the second rail of the slide rail assembly of the furniture system being retracted to be located at a first longitudinal position according to an embodiment of the present invention.

As shown in FIG. 12, the adjusting member 50 can be rotated along the first rotational direction R1, to drive the working member 52 to move to the first position P1. In such state, when the second rail 28 (or the second furniture part 24) is retracted (such as completely retracted) relative to the first rail 26 (or the first furniture part 22), the working member 52 at the first position P1 is configured to abut against the blocking structure 40. For example, the contact part 52*b* of the working member 52 abuts against the blocking member 44 of the blocking structure 40, such that the second rail 28 is located at a first longitudinal position Y1 relative to the first rail 26. Meanwhile, a first distance K1 is defined between the front part 28*a* of the second rail 28 and the blocking structure 40. On the other hand, a first longitudinal distance Z1 is defined between the front panel 36 of the second furniture part 24 and the blocking structure 40.

Figure 13:
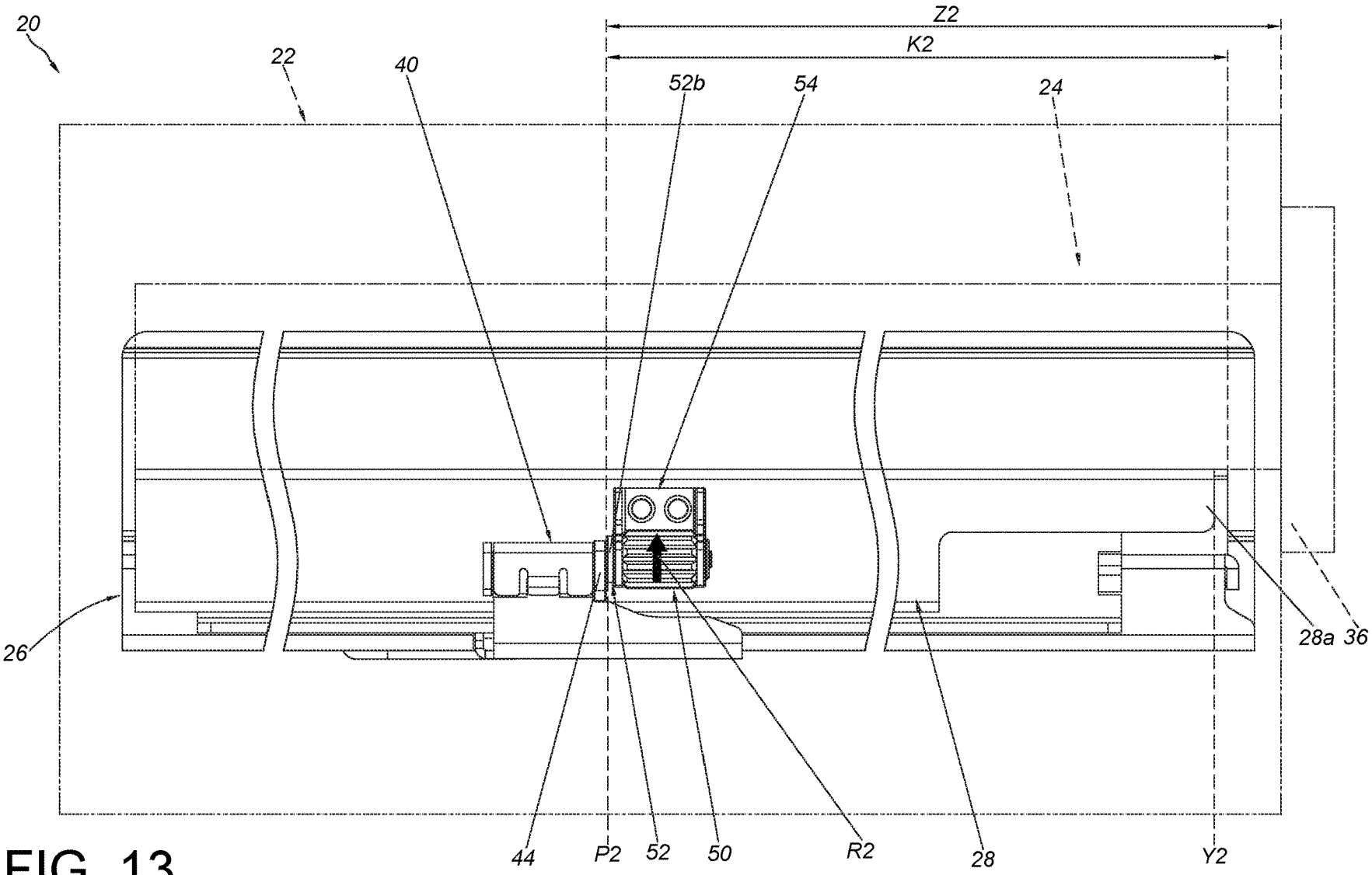
FIG. 13 is a diagram showing the second rail of the slide rail assembly of the furniture system, being retracted to be located at a second longitudinal position according to an embodiment of the present invention.

As shown in FIG. 13, the adjusting member 50 can be rotated along the second rotational direction R2, to drive the working member 52 to move to the second position P2. In such state, when the second rail 28 (or the second furniture part 24) is retracted (such as completely retracted) relative to the first rail 26 (or the first furniture part 22), the working member 52 at the second position P2 is configured to abut against the blocking structure 40. For example, the contact part 52*b* of the working member 52 abuts against the blocking member 44 of the blocking structure 40, such that the second rail 28 is located at a second longitudinal position Y2 relative to the first rail 26. Meanwhile, a second distance K2 is defined between the front part 28*a* of the second rail 28 and the blocking structure 40. On the other hand, a second longitudinal distance Z2 is defined between the front panel 36 of the second furniture and the blocking structure 40. Wherein, the second longitudinal position Y2 is different from the first longitudinal position Y1, the second distance K2 is different from the first distance K1, and the second longitudinal distance Z2 is different from the first longitudinal distance Z1.

Therefore, the furniture system and the slide rail assembly of the present invention are characterized in that:

1. Through adjusting the adjusting member 50, the position of the working member 52 along the linear direction X can be changed (the linear direction X is substantially identical to a longitudinal direction of the first rail 26 or the second rail 28, or a moving direction of the second rail 28 relative to the first rail 26), and the working member 52 is configured to abut against the blocking structure 40, such that the second rail 28 can be located at different longitudinal positions relative to the first rail 26 when the second rail 28 (or the second furniture part 24) is retracted (such as completely retracted) relative to the first rail 26 (or the first furniture part 22). As such, requirement of matching longitudinal depths (or lengths) or mounting tolerances for the first furniture part 22 and the second furniture part 24 can be satisfied.

2. Through arranging the adjusting device 48 and the blocking structure 40 respectively on the movable member and the fixed member of the furniture system, the movable member (such as the second rail 28 or the second furniture part 24) can be located at different longitudinal positions relative to the fixed member (such as the first rail 26 or the first furniture part 22) when the movable member is retracted. Therefore, structural arrangement of the present invention is simpler than that of the prior art, in order to meet specific operation requirements in the market.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A slide rail assembly, comprising:

a first rail;

a second rail longitudinally movable relative to the first rail;

a blocking structure arranged on one of the first rail and the second rail; and an adjusting device arranged on the other one of the first rail and the second rail, the adjusting device comprising an adjusting member, a working member and a fixing frame;

wherein the working member is configured to abut against the blocking structure, the adjusting member is configured to rotate to drive the working member to move linearly relative to the fixing frame, in order to adjust a position of the second rail along a longitudinal direction of the first rail when the second rail is retracted relative to the first rail;

wherein the fixing frame comprises a first wall and a second wall, a space is defined between the first wall and the second wall, the adjusting member is accommodated in the space, the adjusting member has a first side and a second side opposite to the first side, the first side has a shaft part connected to the first wall, a screwing part of the working member is screwed to the adjusting member from the second side, a contact part of the working member is located outside the space, and the working member is configured to abut against the blocking structure through the contact part;

wherein the working member further comprises a middle part connected between the screwing part and the contact part, and the second wall has a hole allowing the middle part to penetrate through; and wherein the hole and the middle part have non-circular contours corresponding to each other.

2. The slide rail assembly of claim 1, wherein the blocking structure is fixed to one of the first rail and the second rail.

3. The slide rail assembly of claim 2, wherein the blocking structure comprises a base having a room and a blocking member accommodated in the room, the blocking member is configured to abut against the working member.

4. The slide rail assembly of claim 1, further comprising a third rail movably mounted between the first rail and second rail for extending a traveling distance of the second rail relative to the first rail.

5. A slide rail assembly, comprising:

a first rail;

a second rail longitudinally movable relative to the first rail, the second rail having a front part and a rear part;

a blocking structure arranged on the first rail; and an adjusting device arranged on the second rail, the adjusting device comprising a working member and an adjusting member, wherein the working member and the adjusting member are screwed to each other;

wherein when the second rail is retracted relative to the first rail and the working member is adjusted by the adjusting member to be located at a first position to abut against the blocking structure, a first distance is defined between the front part of the second rail and the blocking structure;

wherein when the second rail is retracted relative to the first rail and the working member is adjusted by the adjusting member to be located at a second position to abut against the blocking structure, a second distance is defined between the front part of the second rail and the blocking structure, the second distance is different from the first distance;

wherein the adjusting device further comprises a fixing frame fixed to the second rail, the fixing frame comprises a first wall and a second wall, a space is defined between the first wall and the second wall, the adjusting member is accommodated in the space, the adjusting member has a first side and a second side opposite to the first side, the first side has a shaft part connected to the first wall, a screwing part of the working member is screwed to the adjusting member from the second side, a contact part of the working member is located outside the space, and the working member is configured to abut against the blocking structure through the contact part;

wherein the working member further comprises a middle part connected between the screwing part and the contact part, and the second wall has a hole allowing the middle part to penetrate through; and wherein the hole and the middle part have non-circular contours corresponding to each other.

6. The slide rail assembly of claim 5, wherein the blocking structure is fixed to the first rail.

7. The slide rail assembly of claim 5, further comprising a third rail movably mounted between the first rail and the second rail for extending a traveling distance of the second rail relative to the first rail.

8. The slide rail assembly of claim 5, wherein the blocking structure comprises a base having a room and a blocking member accommodated in the room, the blocking member is configured to abut against the working member.

9. The slide rail assembly of claim 8, wherein the blocking member is fixed to the base.

10. A furniture system, comprising:

a first furniture part and a second furniture part;

a first rail fixed to the first furniture part;

a second rail configured to carry the second furniture part, the second rail being longitudinally movable relative to the first rail;

a blocking structure arranged on one of the first rail and the first furniture part; and an adjusting device arranged on one of the second rail and the second furniture part, the adjusting device comprising a working member and an adjusting member, wherein the working member and the adjusting member are screwed to each other;

wherein when the second rail is retracted relative to the first rail and the working member is adjusted by the adjusting member to be located at a first position to abut against the blocking structure, a first longitudinal distance is defined between a front panel of the second furniture part and the blocking structure;

wherein when the second rail is retracted relative to the first rail and the working member is adjusted by the adjusting member to be located at a second position to abut against the blocking structure, a second longitudinal distance is defined between the front panel of the second furniture part and the blocking structure, the second longitudinal distance is different from the first longitudinal distance;

wherein the adjusting device further comprises a fixing frame fixed to one of the second rail and the second furniture part, the fixing frame comprises a first wall and a second wall, a space is defined between the first wall and the second wall, the adjusting member is accommodated in the space, the adjusting member has a first side and a second side, the first side has a shaft part connected to the first wall, a screwing part of the working member is screwed to the adjusting member from the second side, a contact part of the working member is located outside the space, and the working member is configured to abut against the blocking structure through the contact part;

wherein the working member further comprises a middle part connected between the screwing part and the contact part, and the second wall has a hole allowing the middle part to penetrate through; and wherein the hole and the middle part have non-circular contours corresponding to each other.

11. The furniture system of claim 10, further comprising a third rail movably mounted between the first rail and the second rail for extending a traveling distance of the second rail relative to the first rail.

* * * * *